United States Patent [19]

McConnell

[11] Patent Number: 4,732,291

[45] Date of Patent: Mar. 22, 1988

[54] BABY BOTTLE NIPPLE, COLLAR, CAP RING AND PACIFIER DISHWASHER ENCLOSURE

[76] Inventor: Thomas E. McConnell, 6 Liveoak, Irvine, Calif. 92714

[21] Appl. No.: 934,951

[22] Filed: Nov. 26, 1986

[51] Int. Cl.[4] ..... B65D 6/08; B65D 1/36

[52] U.S. Cl. ..... 220/19; 220/20

[58] Field of Search ..... 220/19, 20

[56] References Cited

U.S. PATENT DOCUMENTS

| | | | |
|---|---|---|---|
| 1,292,935 | 1/1919 | Walsh | 220/20 |
| 1,496,957 | 6/1924 | Walker | 220/20 |
| 2,367,448 | 1/1945 | Thiele | 220/19 |
| 2,586,005 | 2/1952 | Colonna | 220/19 |
| 2,620,588 | 9/1952 | Critser | 220/19 |
| 4,512,489 | 4/1985 | Green | 220/19 |

*Primary Examiner*—George F. Lowrance

*Attorney, Agent, or Firm*—Stetina and Brunda

[57] ABSTRACT

An assembly is disclosed for storing baby bottle nipples, collars, cap rings and pacifiers to facilitate cleansing in an automatic dishwasher or the like. The assembly comprises a first storage area for holding baby bottle collars, cap rings and pacifiers and a second storage area for holding nipples. The first storage area is formed of a plurality of sections of wire frame material forming side walls, end walls, a bottom portion and a retractable upper lid. The nipple storage area is defined by a lower lid extending between the end walls beneath the bottom portion. The bottom portion is formed of wire segments spaced to receive and frictionally engage the nipples between adjacent segments. The nipples may be urged into engagement with the bottom portion by closing the lower lid.

15 Claims, 6 Drawing Figures

Fig. 1
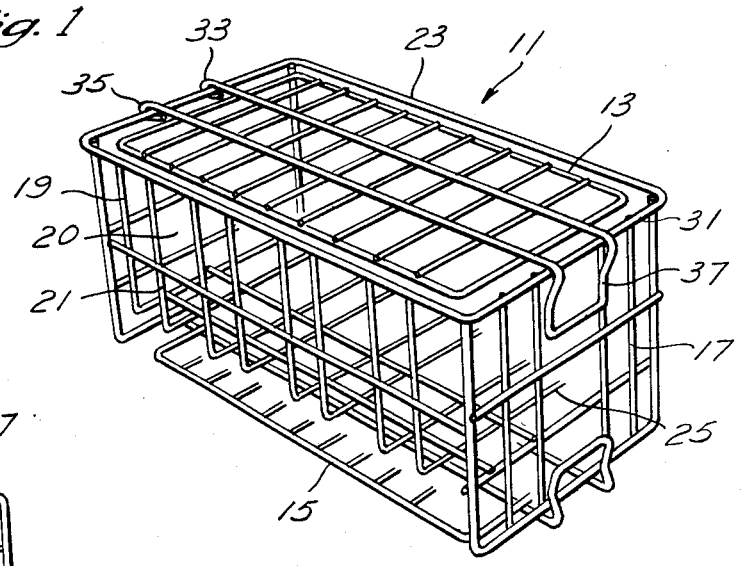
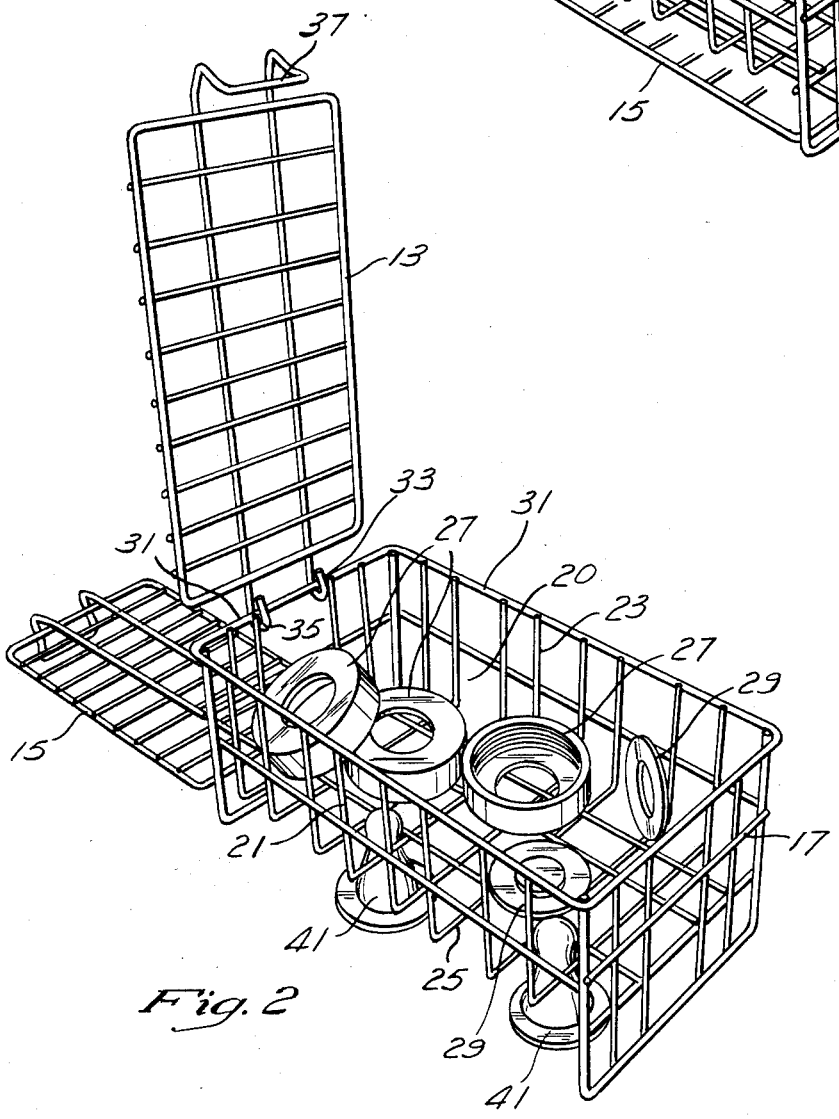
Fig. 2

BABY BOTTLE NIPPLE, COLLAR, CAP RING AND PACIFIER DISHWASHER ENCLOSURE

BACKGROUND OF THE INVENTION

The present invention relates to storage containers and, more particularly, to an enclosure for holding collars, cap rings, pacifiers and nipples for baby bottles, suitable for use in a dishwasher.

Contemporary dishwashers and dishwasher accessories include a variety of racks and different types of storage compartments that are suitable for holding different types of dishes and utensils, while exposing them for proper cleaning in a dishwasher. However, certain types of articles are sized or shaped such that conventional racks and container devices are inadequate to simultaneously hold such articles while exposing them for proper cleaning. Nipples, collars, and cap rings for baby bottles are exemplary of such articles that are not adequately supported and maintained in place for proper washing by conventional dishwasher racks and storage containers.

Several types of containers and other types of supports have been proposed to address the deficiencies of the conventional dishwasher racks and storage containers. One such container is a nipple rack formed of a wire frame construction and sized to receive a plurality of nipples disposed in linear array. Though such containers are suitable for holding nipples they are not designed for holding collars, cap rings and pacifiers, which must be stored separate from nipples.

Other contemporary devices are designed to hold and facilitate washing the collars. One such article is a flat, thin layer of resilient material formed to have peripheral portions shaped to fit within the collars and hold them in place. Such articles are unsatisfactory in that they require undue manipulation of the collars for mounting and further in that the material interfaces with the cleaning of the inside of the collar. Another contemporary device for holding and facilitating the washing of collars is a ring adapted to fit through the apertures in the collars. The ring may then be secured to a convenient portion of the dishwasher rack. Such articles also require undue manipulation of the collars and fail to provide any means for holding and washing the cap rings, nipples or pacifiers.

Accordingly, the present invention is directed to an assembly that addresses the deficiencies in contemporary devices by providing a device that can conveniently hold and facilitate washing collars, cap rings, nipples, and pacifiers, without requiring undue manipulation of those articles. The assembly is readily adapted for use in a conventional dishwasher without any need to modify the diswasher rack, or connect the assembly to the rack.

SUMMARY OF THE INVENTION

An assembly is disclosed for storing baby bottle nipples, collars, cap rings, and pacifiers to facilitate cleansing in an automatic dishwasher or the like. The assembly comprises a first storage area for holding baby bottle collars, cap rings and pacifiers and a second storage area for holding nipples. The first storage area is formed of a plurality of sections of wire frame material forming side walls, end wall, a bottom portion and a retractable upper lid. The nipple storage area is defined by a lower lid extending between the end walls beneath the bottom portion. The bottom portion is formed of wire segments spaced to receive and frictionally engage the nipples between adjacent segments. The nipples may be urged into engagement with the bottom portion by closing the lower lid.

BRIEF DESCRIPTION OF THE DRAWINGS

FIG. 1 is a perspective view of the presently preferred embodiment of the invention;

FIG. 2 illustrates the assembly of FIG. 1 with the upper and lower lids in the open position and articles sotred therein;

DETAILED DESCRIPTION OF THE PREFERRED EMBODIMENT

Figure 3:
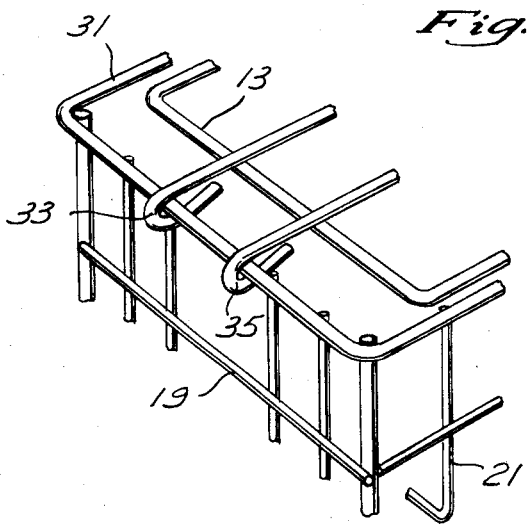
FIG. 3 illustrates exemplary means for hinging the upper and lower lids.

The detailed description set forth below in connection with the appended drawings is intended merely as a description of the presently preferred embodiment of the invention, and is not intended to represent the only form in which the present invention may be constructed or utilized. The description sets forth functions and steps for utilizing the invention in connection with the illustrated embodiment. It is to be understood, however, that the same or equivalent constructions and applications may be accomplished by different embodiments that are also intended to be encompassed within the spirit and scope of the invention.

FIG. 1 illustrates a perspective view of the presently preferred embodiment of the invention in closed position. As shown therein assembly 11 is preferably formed of a wire frame construction wherein the wire segments are spaced sufficiently close to preclude stored articles from passing therethrough, while exposing the articles for cleansing in a dishwasher. The wire segments are preferably coated with a plastic material having sufficient heat resistant qualities to permit use in a dishwasher. It is anticipated, however, that other materials such as solid plastics may also be used to construct the assembly.

As shown at FIGS. 1 and 2 the assembly 11 generally comprises a retractable upper lid 13, a retractable lower lid 15, end walls 17 and 19, side walls 21 and 23, and bottom portion 25. End walls 17, 19, side walls 21, 23 upper lid 13 and bottom portion 25 collectively form a first storage area 20 adapted to receive bottle collars 27, cap rings 29 and pacifiers. Upper lid 13 is provided with hinge means 33, 35 to facilitate attachment of lid 13 to the periphery 31 of the storage area 20. Upper lid 13 is preferably sized to extend proximate the periphery 31 of the basket when lid 13 is in the closed position, as shown at FIG. 1. Lid 13 is further provided with fastening means such as clasp 37 adapted to detachably engage the periphery 31 of the storage area 20 adjacent end wall 17 to maintain the lid 13 in closed position when in use.

Figure 5:
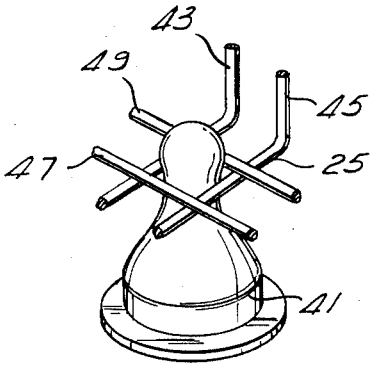
FIG. 5 illustrates means for securing nipples within the assembly.
Figure 6:
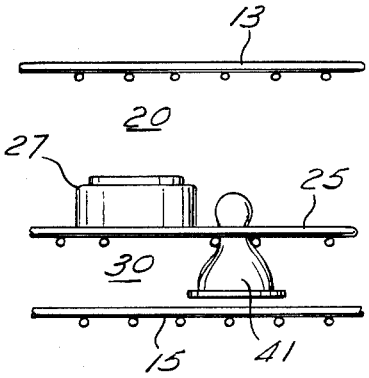
FIG. 6 is a side view of the assembly showing a collar and nipple stored therein.

Though nipples may be stored within the basket along with the collars 27, cap rings 29, and pacifiers, the nipples are preferably stored separately below the basket to facilitate proper washing. As shown at FIGS. 2, 5 and 6 nipples 41 may be stored beneath the bottom portion 25 within the second storage area 30, defined by bottom lid 15, portions of side walls 17, 19, and lower surface 25. The nipples 41 may be disposed so as to extend through the wire framework forming bottom surface 25, or may be disposed to extend through the wire framework forming lower lid 15. In each case the nipples are securely held in place within nipple retaining area 30 to facilitate cleaning of the nipples. As shown in more detail at FIG. 6 the wire framework forming the lower surface 25 may be formed to have wires separated an appropriate distance to receive and frictionally engage the nipple to ensure that they remain in place. Lower lid 15 is preferably spaced from bottom portion 25 such that the nipples are urged into engagement with the bottom portion 25 as the lower lid 15 is closed. However, it is anticipated that the nipples will remain securely within nipple retaining area 30 without the need to have the nipples in frictional engagement with the wire segments forming bottom portion 25 or lower lid 15. The height of nipple storage area 30, and consequently the extension of the nipple through bottom portion 25, may be varied as desired, most conveniently by varying the extension of end walls 17, 19 beyond bottom surface 25.

Although in the presently preferred embodiment it is contemplated that baby bottle type apparatus will be utilized in the present invention such as baby bottle nipples, collars and cap rings, those skilled in the art will recognize that other small items such as teethers, pacifiers and other items which typically become dislodged in a conventional dishwasher may be used herein and for purposes of this application the terms baby bottle nipples, collars and cap rings shall be defined to include all such above items.

FIG. 3 illustrates the manner in which upper lid 13 or lower lid 15 may be pivotally secured to end wall 19. As shown at FIG. 3 upper lid 13 may be hinged to the periphery 31 by means of hinges 33 and 35. It is to be understood that the hinges 33 and 35 may be spaced apart any convenient distance and may be replaced by other types of hinging devices or retractable assemblies to permit opening of the assembly.

Figure 4:
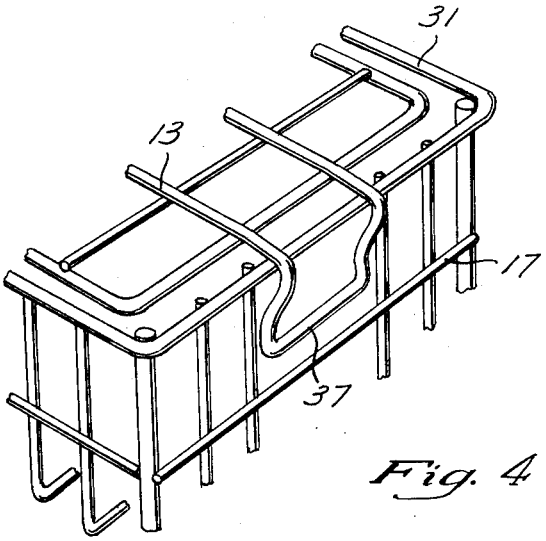
FIG. 4 illustrates exemplary means for securing the upper and lower lids.

FIG. 4 illustrates an exemplary manner by which the upper lid 13 or the lower lid 15 may be secured to the end wall 17. As shown at FIG. 4 upper lid 13 may be detachably secured to the periphery 31 of the assembly by means of clasp 37 which may be readily displaced to facilitate opening of the assembly. It is to be understood that various other types of clasps or fastening means may be implemented to open and close the assembly.

FIG. 5 illustrates the manner in which nipple 41 extends through adjacent wire segments 43, 45 and 47, 49 to maintain nipple 41 securely in place. The wire frame construction may be formed such that certain of the parallel wire segments are spaced closer than others to array the nipples in any desired pattern within the assembly.

As will be recognized by those of ordinary skill in the art various functions and features of the invention may be modified without departing from the broader aspects of the invention. For example, the precise shape of the wire framework, as well as the means for clasping and hinging the lids may be modified consistent with desired design features, economies of manufacture and the requirements for particular application. Moreover, it is further anticipated that the assembly may be modified such that the nipples, collars, cap rings and pacifiers are inserted into the assembly through a common lid and disposed in separate compartments defined by a retractable intermediate lid. These and other modifications, additions and enhancements may be implemented within the spirit and scope of the invention as described and claimed.

What is claimed is:

1. An assembly for holding and facilitating the washing of baby bottle nipples, collars, cap rings and pacifiers, the assembly comprising:

a first storage area for holding baby bottle collars, cap rings and pacifiers, said first storage area being defined by a pair of side walls, a pair of end walls, a bottom portion having a plurality of apertures therethrough and a retractable upper lid; and a second storage area for holding baby bottle nipples, said second storage area being defined by a retractable lower lid detachably connected to and extending between said end walls beneath said bottom portion, said retractable lower lid being positionable in open and closed positions and being formed such that, when in said closed position, said lower lid will urge at least a portion of each nipple through at least one of said apertures thereby frictionally retaining said nipple(s) within said second storage area.

2. The assembly as recited in claim 1 wherein said side walls, end walls, bottom portion and upper lid are formed of a segmental frame construction to permit water to pass therethrough to wash the collars, cap rings and pacifiers disposed said first storage area.

3. The assembly as recited in claim 1 wherein said lower lid is formed of segmental frame construction to permit water to pass therethrough to wash the nipples disposed in said second storage area.

4. The assembly as recited in claim 2 wherein said bottom portion is formed of a plurality of spaced segments, said segments being spaced to receive and frictionally engage the nipples between adjacent segments.

5. The assembly as recited in claim 3 wherein said lower lid is formed of a plurality of spaced segments, said segments being spaced to receive and frictionally engage the nipples between adjacent segments of said bottom section.

6. The assembly as recited in claim 1 wherein said lower lid, when in said closed position, is disposed in spaced parallel relation to said bottom portion.

7. The assembly as recited in claim 1 wherein said upper lid is formed to have a peripheral portion extendable proximate said side walls and said end walls.

8. The assembly as recited in claim 6 wherein the nipples are urged into engagement with said bottom portion by closing said lower lid.

9. A multi-compartment receptacle for storing nipples, collars, cap rings and pacifiers for cleaning in a dishwasher, comprising:

a first storage area formed of a plurality of sections of wire frame material, said sections comprising first and second side wall portions, first and second end wall portions, a bottom portion and a top portion, at least one of said portions being retractable to form an opening to said first storage area for receiving the collars, cap rings and pacifiers; and a retractable lid connected to at least one of said sections so as to define a nipple storage area therebetween, said one of said sections being provided with a plurality of apertures formed to receive a portion of a baby bottle nipple therethrough and, in cooperation with said retractable lid, to frictionally retain said nipple within said nipple storage area.

10. The assembly as recited in claim 9 wherein said retractable lid is formed of a segmental frame material.

11. The assembly as recited in claim 9 wherein said retractable lid is pivotally connected to said first end portion and detachably connected to said second end portion.

12. The assembly as recited in claim 11 wherein said nipple storage area is defined by said first and second end walls, said bottom portion and said retractable lower lid.

13. The assembly as recited in claim 12 wherein said top portion is retractable to form an opening to said first storage area.

14. The assembly as recited in claim 13 wherein said bottom portion is formed of a plurality of spaced segments, said segments being spaced to receive and frictionally engage said nipples between adjacent segments.

15. The assembly as recited in claim 14 wherein the nipples are urged into frictional engagement with said bottom portion by closing said retractable lid.

* * * * *